US009385434B2

(12) United States Patent
Doskocil

(10) Patent No.: US 9,385,434 B2
(45) Date of Patent: Jul. 5, 2016

(54) MIMO ANTENNA ASSEMBLY HAVING REDUCED PACKAGING SIZE

(71) Applicant: MP Antenna Ltd., Elyria, OH (US)

(72) Inventor: Adam Doskocil, Stow, OH (US)

(73) Assignee: MP Antenna Ltd., Elyria, OH (US)

( * ) Notice: Subject to any disclaimer, the term of this patent is extended or adjusted under 35 U.S.C. 154(b) by 422 days.

(21) Appl. No.: 13/804,457

(22) Filed: Mar. 14, 2013

(65) Prior Publication Data

US 2014/0266958 A1 Sep. 18, 2014

(51) Int. Cl.
*H01Q 9/44* (2006.01)
*H01Q 21/06* (2006.01)
*H01Q 21/26* (2006.01)

(52) U.S. Cl.
CPC ..... *H01Q 9/44* (2013.01); *H01Q 21/061* (2013.01); *H01Q 21/26* (2013.01)

(58) Field of Classification Search
CPC ..... H01Q 1/2291; H01Q 1/246; H01Q 1/36; H01Q 1/52; H01Q 1/521; H01Q 1/523; H01Q 5/342; H01Q 5/35; H01Q 9/32; H01Q 9/44; H01Q 9/46; H01Q 1/2258; H01Q 1/2266; H01Q 1/24; H01Q 1/241; H01Q 1/242; H01Q 1/243; H01Q 5/307; H01Q 21/061; H01Q 21/26
See application file for complete search history.

(56) References Cited

U.S. PATENT DOCUMENTS

| | | | | |
|---|---|---|---|---|
| 6,346,920 | B2 * | 2/2002 | Sharp | H01Q 13/00 343/773 |
| 7,019,709 | B2 * | 3/2006 | Fukushima et al. | 343/846 |
| 7,236,129 | B2 * | 6/2007 | Nilsson | 343/700 MS |
| 8,717,250 | B2 * | 5/2014 | Nilsson | H01Q 9/28 343/893 |

* cited by examiner

*Primary Examiner* — Sue A Purvis
*Assistant Examiner* — Patrick Holecek
(74) *Attorney, Agent, or Firm* — Tarolli, Sundheim, Covell & Tummino, LLP

(57) ABSTRACT

A multiple input, multiple output (MIMO) antenna system includes an electrically conductive, substantially planar, ground reference and a plurality of antenna assemblies electrically connected to respective antenna feeds at respective connection points. The antenna assemblies extend on a first side of the ground reference and are formed from a conductive material. Each antenna assembly is rotationally asymmetric around an axis perpendicular to the ground reference and passing through the connection point.

20 Claims, 4 Drawing Sheets

MIMO ANTENNA ASSEMBLY HAVING REDUCED PACKAGING SIZE

BACKGROUND OF THE INVENTION

Multiple-input, multiple-output (MIMO) technology has attracted attention in wireless communications, because it offers significant increases in data throughput and link range without additional bandwidth or increased transmit power. It achieves this goal by spreading the same total transmit power over the antennas. Because of these properties, MIMO is an important part of many modern wireless communication standards.

BRIEF SUMMARY OF THE INVENTION

In accordance with an aspect of the invention, a multiple input, multiple output (MIMO) antenna system includes an electrically conductive, substantially planar, ground reference and a plurality of antenna assemblies electrically connected to respective antenna feeds at respective connection points. The antenna assemblies extend on a first side of the ground reference and are formed from a conductive material. Each antenna assembly is rotationally asymmetric around an axis perpendicular to the ground reference and passing through the connection point.

In accordance with another aspect of the invention, a multiple input, multiple output (MIMO) antenna system includes an electrically conductive, substantially planar, ground reference and a plurality of antenna assemblies electrically connected to respective antenna feeds at respective connection points. Each antenna assembly extends on a first side of the ground reference and is formed from multiple conductive elements joined at a common apex and extending at an oblique angle relative to the ground plane.

In accordance with yet another aspect of the present invention, a MIMO antenna system includes a substantially circular planar ground reference and three antenna assemblies extending on a first side of the ground reference. The three antenna assemblies are electrically connected to respective antenna feeds at respective connection points evenly spaced around a circle having its center at the centroid of the ground plane. Each of the plurality of antenna assemblies is formed from a conductive material and includes multiple conductive elements joined at a common apex and extending at an oblique angle relative to the ground plane.

BRIEF DESCRIPTION OF THE DRAWINGS

The foregoing and other features of the present invention will become apparent to those skilled in the art to which the present invention relates upon reading the following description with reference to the accompanying drawings, in which.

DETAILED DESCRIPTION OF THE INVENTION

Figure 1:
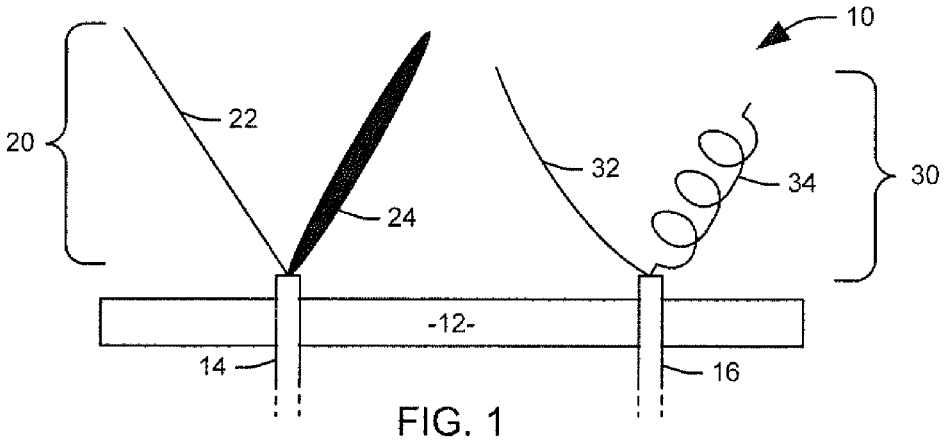
FIG. 1 illustrates a side view of an implementation of a multiple-input, multiple-output (MIMO) antenna system for transmitting and receiving radio frequency signals in accordance with various aspects of the present invention.

FIG. 1 illustrates a side view of an implementation of a multiple-input, multiple-output (MIMO) antenna system. 10 for transmitting and receiving radio frequency signals in accordance with various aspects of the present invention. It will be appreciated that the term "radio frequency," as used herein, is intended to encompass frequencies within the microwave and traditional radio bands, specifically frequencies between 3 kHz and 3 THz. While the illustrated MIMO antenna system 10 is capable of some wideband performance, it will be appreciated that the antenna system 10 is tuned to a characteristic frequency, $\eta$, representing a frequency band to which the antenna is maximally receptive. Accordingly, the antenna system also has a characteristic wavelength, $\lambda$, equal to $c/\eta$, where c represents the speed of light, equal to approximately 300,000,000 m/s.

The MO antenna system 10 comprises an electrically conductive, substantially planar, ground reference 12 and a plurality of antenna feeds 14 and 16. The ground reference 12 may be comprised of any appropriate electrically conductive material such as, for example, copper or stainless steel. Each antenna feed 14 and 16 is operatively connected to an antenna assembly 20 and 30 at associated connection points, with the antenna assemblies 20 and 30 each formed from a conductive material and extending on a same side of the planar ground reference 12. The antenna feeds 14 and 16 can each include, for example, a SubMiniature, version A (SMA) coaxial connector, or a similar connector, and a transmitter/receiver circuit board (not shown). The connector and circuit board can be electrically connected together by a length of coaxial cable. An SMA connector allows a center conductor of the coaxial cable to electrically connect to the associated antenna assembly 20 and 30 and allows a ground braid of the coaxial cable to electrically connect to the ground reference 12. A dielectric material can be used to electrically insulate the center conductor and the antenna assembly 20 and 30 from the ground reference 12.

Each antenna assembly is tuned to operate at or around the characteristic frequency of the antenna system 10. As will be described in more detail below, these antenna assemblies may exhibit significant wideband sensitivity, so it will be appreciated, for example, that an assembly tuned "at or around" a characteristic frequency of 2.4 GHz can be receptive to signals over a band of several gigahertz that includes the characteristic frequency. In accordance with an aspect of the present invention, the antenna assemblies 20 and 30 can be positioned in close proximity to decrease the necessary size of the planar ground reference 12. Specifically, the antenna assemblies 20 and 30 can be separated by less than one-quarter of the characteristic wavelength of the antenna system 10 while still maintaining substantial independence among the antenna assemblies (e.g., a correlation coefficient of less than 0.5).

To facilitate independent operation of the antenna assemblies, each antenna assembly 20 and 30 is shaped to be rotationally asymmetric around an axis perpendicular to the planar ground reference 12 and passing through the connection point with the antenna feed 14 and 16. By "rotationally asymmetric," it is meant that, when viewed at a position distal from the antenna assembly along the axis, a full three-hundred sixty degree rotation would be necessary for the antenna assembly to return to shape and configuration substantially identical to that of an initial orientation. The inventors have found that the substantial polarization diversity provided by the illustrated antenna assemblies 20 and 30 allow the spacing between the various antenna assemblies to be substantially reduced. In one implementation, the antenna assemblies 20 and 30 can have overlapping footprints in a plane parallel to the planar ground reference 12. In the illustrated example, each antenna assembly 20 and 30 is formed from a plurality of radiative elements 22, 24, 32, and 34 joined at a common apex and extending at an oblique angle from the planar ground reference. It will be appreciated, as illustrated in FIG. 1, the radiative elements 22, 24, 32, and 34 can be of different lengths and/or shapes, such that the antenna assembly 10 exhibits significant frequency and polarization diversity. In combination with the inherent spatial diversity of a MIMO arrangement, the frequency and polarization diversity of the antenna assemblies 20 and 30 allows for robust performance of the antenna system 10.

Figure 2:
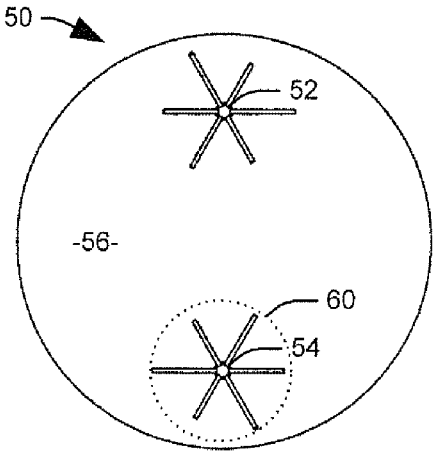
FIG. 2 illustrates an overhead view of a first example of an antenna system in accordance with an aspect of the present invention.
Figure 3:
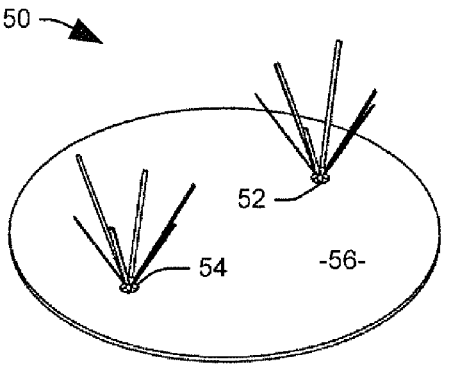
FIG. 3 illustrates a perspective view of the antenna system illustrated in FIG. 2.
Figure 4:
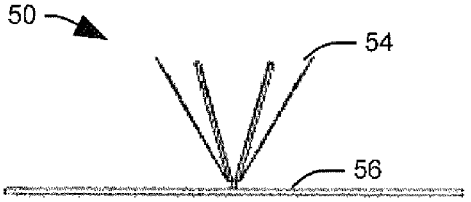
FIG. 4 illustrates a first side view of the antenna system illustrated in FIG. 2.
Figure 5:
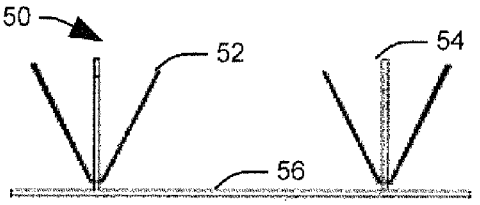
FIG. 5 illustrates a second side view of the antenna system illustrated in FIG. 2 along an axis perpendicular to that of the view presented in FIG. 4.

FIG. 2 illustrates an overhead view of a first example of an antenna system 50 in accordance with an aspect of the present invention. FIG. 3 illustrates a perspective view of the antenna system 50 illustrated in FIG. 2. FIG. 4 illustrates a first side view of the antenna system 50 illustrated in FIG. 2. FIG. 5 illustrates a second side view of the antenna system 50 illustrated in FIG. 2 along an axis perpendicular to that of the view presented in FIG. 4. FIGS. 2-5 each share common numbering for the various elements comprising the antenna system 50.

The illustrated antenna system 50 comprises two substantially identical antenna assemblies 52 and 54 arranged along a diameter of an associated circular ground plane 56. Each antenna assembly 52 and 54 includes a plurality of linear elements of differing lengths joined at a common apex at respective first ends. In accordance with an aspect of the present invention, each linear element of each antenna assembly 52 and 54 extends at an oblique angle relative to the ground plane 56. In the illustrated implementation, the oblique angle is substantially equal to sixty degrees for each of the linear elements, although it will be appreciated that, in some implementations, the angle can be varied from: element to element. The linear elements can be evenly spaced around the connection point, such that, in the illustrated six element system, the elements positioned at intervals of approximately sixty degrees. While the specific geometry of the antenna system 50 can vary, in the illustrated implementation, the connection points of each antenna assembly is positioned as to be spaced evenly around a circle having its center at the centroid of the ground plane.

The illustrated antenna system 50 is configured to operate in a frequency band around 2.4 gigahertz. Accordingly, the lengths of the linear elements can lie in a range including a quarter of a wavelength associated this frequency, specifically around 1.23 inches. In the illustrated implementation, none of the linear elements have a same length. A first element has a length of approximately seven-eights of an inch, a second element has a length of approximately fifteen-sixteenths of an inch, a third element has a length of approximately an inch, a fourth element has a length of approximately one and one-eighth inches, a fifth element has a length of approximately one and one-quarter inches, and a sixth element has a length of approximately one and three-eights inches. It will be appreciated that these lengths are merely provided for the purpose of example, and other lengths within a range around one quarter of the characteristic wavelength could be used. Further, it will be appreciated that the range itself, and its associated lengths, will vary essentially linearly with the characteristic wavelength of the system 50.

In accordance with an aspect of the present invention, the antenna assemblies 52 and 54 can be spaced closer together to one another than existing MIMO antennas. For example, the antenna assemblies 52 and 54 of the illustrated assembly can be separated by a distance just over a quarter of the characteristic wavelength of the antenna system 50 while still maintaining a correlation coefficient greater than 0.5. This allows for a significant reduction in the size of the ground plane, such that a maximum distance between any two points on the ground plane can be less than one wavelength associated with an operating frequency of the antenna. In the illustrated implementation, it will be noted that an associated footprint 60 of each of the plurality of antenna assemblies has a reasonably large diameter. Due to the reduced size of the ground plane, this footprint can actually have a diameter that is not less than one-quarter of a diameter of the ground plane.

Figure 6:
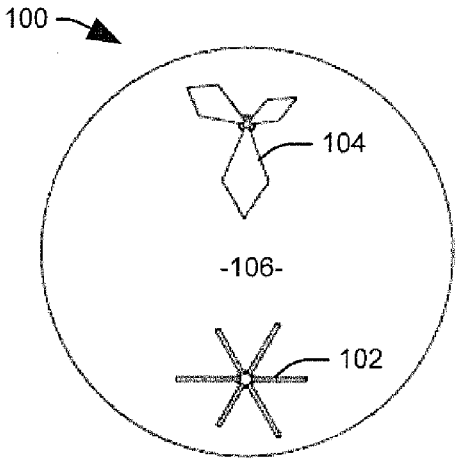
FIG. 6 illustrates an overhead view of a second example of an antenna system in accordance with an aspect of the present invention.
Figure 7:
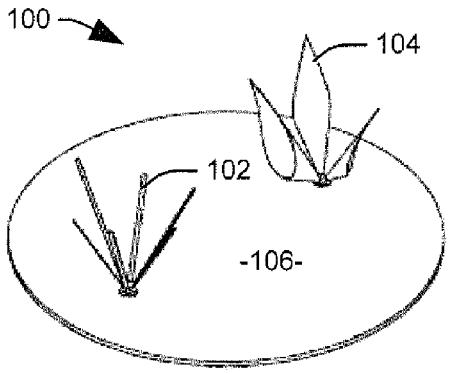
FIG. 7 illustrates a first perspective view of the antenna system illustrated in FIG. 6.
Figure 8:
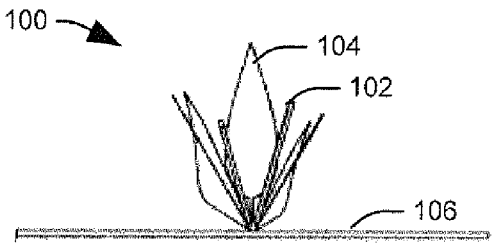
FIG. 8 illustrates a first side view of the antenna system illustrated in FIG. 6.
Figure 9:
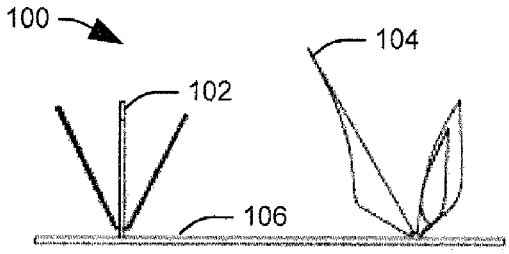
FIG. 9 illustrates a second side view of the antenna system illustrated in FIG. 6 along an axis perpendicular to that of the view presented in FIG. 8.

FIG. 6 illustrates an overhead view of a second example of an antenna system 100 in accordance with an aspect of the present invention. FIG. 7 illustrates a first perspective view of the antenna system 100 illustrated in FIG. 6. FIG. 8 illustrates a first side view of the antenna system 100 illustrated in FIG. 6. FIG. 9 illustrates a second side view of the antenna system 100 illustrated in FIG. 6 along an axis perpendicular to that of the view presented in FIG. 8. FIGS. 6-9 each share common numbering for the various elements comprising the antenna system 100.

The illustrated antenna system 100 comprises two antenna assemblies 102 and 104 arranged along a diameter of an associated circular ground plane 106. A first antenna assembly 102 includes a plurality of linear elements of differing lengths joined at a common apex at respective first ends in a configuration similar to the antenna assemblies 52 and 54 of FIGS. 2-5. It will be appreciated, however, that the antenna assemblies 102 and 104 of FIGS. 6-9 are separated by approximately a quarter of the characteristic wavelength while still maintaining a correlation coefficient greater than 0.5.

A second antenna assembly 104 comprises a plurality of radiative elements formed as oblique, elliptical cones, with each of the cones having an open base and being connected to the connection point and to one another at their respective apexes. The sides of the conical radiative elements can be either solid or formed from a mesh of appropriate size for the operating frequency of the antenna. It will be appreciated that the radiative elements in the second antenna assembly may show some deviation from a perfect conical shape, particular in that the open base of the cone may be curved in a manner departing from a plane defined by the base. In the illustrated implementation, each conical radiative element of the second antenna assembly 104 spans an angle relative to the ground plane 106 from approximately a fifty-five degrees to eighty degrees, such that the conical element extends at an oblique angle relative to the ground plane. It will be appreciated, however, that these upper and lower angles can be varied from element to element. The conical elements can be evenly spaced around the connection point, such that, in the illustrated three element system, the elements positioned at intervals of approximately one hundred twenty degrees.

Figure 10:
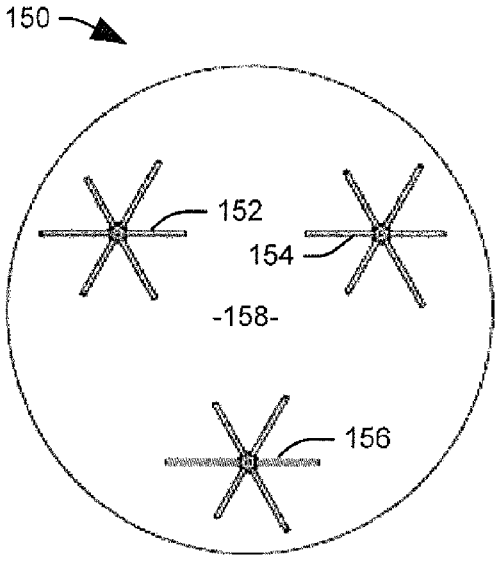
FIG. 10 illustrates an overhead view of a third example of an antenna system in accordance with an aspect of the present invention.

FIG. 10 illustrates an overhead view of a third example of an antenna system. 150 in accordance with an aspect of the present invention.

Figure 11:
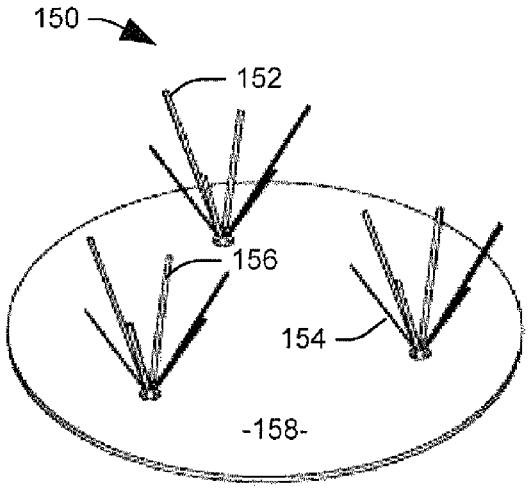
FIG. 11 illustrates a first perspective view of the antenna system illustrated in FIG. 10.
Figure 12:
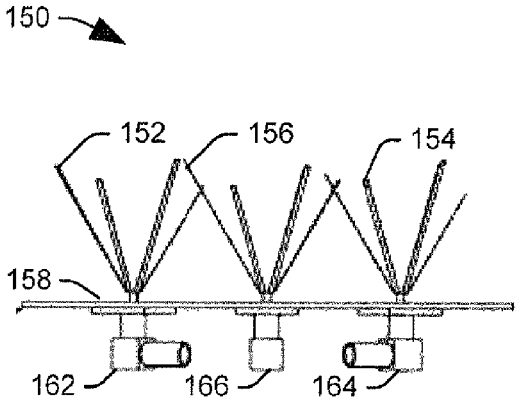
FIG. 12 illustrates a side view of the antenna system illustrated in FIG. 10.
Figure 13:
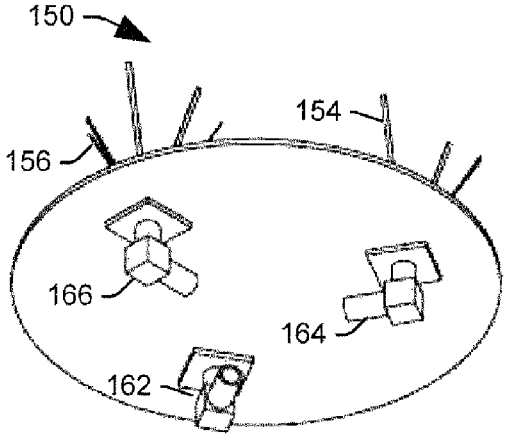
FIG. 13 illustrates a second perspective view of the antenna system illustrated in FIG. 10.

FIG. 11 illustrates a first perspective view of the antenna system 150 illustrated in FIG. 10. FIG. 12 illustrates a side view of the antenna system 150 illustrated in FIG. 10. FIG. 13 illustrates a second perspective view of the antenna system 150 illustrated in FIG. 10. FIGS. 10-13 each share common numbering for the various elements comprising the antenna system. 150.

The illustrated antenna system 150 comprises three antenna assemblies 152, 154, and 156 connected to associated antenna feed connectors 162, 164, and 166 through an associated circular ground plane 158. Each antenna assembly 152, 154, and 156 includes a plurality of linear elements of differing lengths joined at a common apex at respective first ends in a configuration similar to the antenna assemblies 52 and 54 of FIGS. 2-5. In the illustrated implementation, the connection points of each antenna assembly 152, 154, and 156 is positioned as to be spaced evenly around a circle having its center at the centroid of the ground plane. In this configuration, the antenna assemblies 152, 154, and 156 can be separated by a distance significantly less than a quarter of the characteristic wavelength of the antenna system 150 while still maintaining a correlation coefficient greater than 0.5.

It will be appreciated that the three antenna assemblies 152, 154, and 156 share a common three-dimensional shape. In the illustrated implementation, however, each antenna assembly 152, 154, and 156 is rotated one hundred and twenty degrees relative to the neighboring antenna assemblies, such that a same location on the common three-dimensional shape faces a centroid of the ground plane for each antenna assembly.

Figure 14:
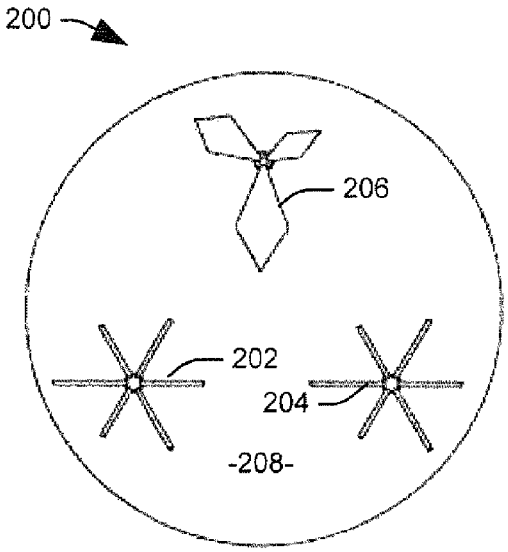
FIG. 14 illustrates an overhead view of a fourth example of an antenna system in accordance with an aspect of the present invention.
Figure 15:
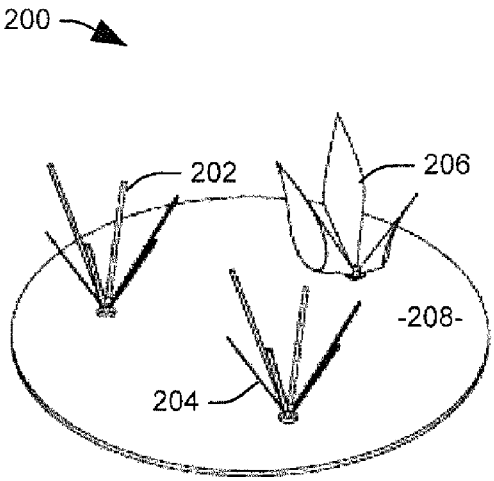
FIG. 15 illustrates a first perspective view of the antenna system illustrated in FIG. 14.
Figure 16:
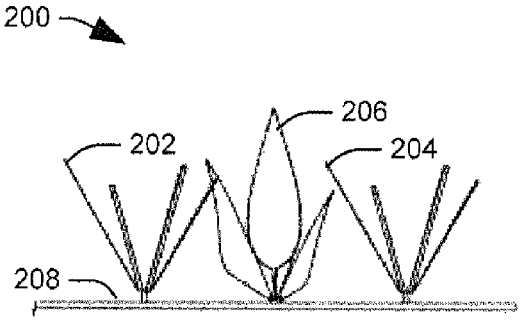
FIG. 16 illustrates a side view of the antenna system illustrated in FIG. 14.
Figure 17:
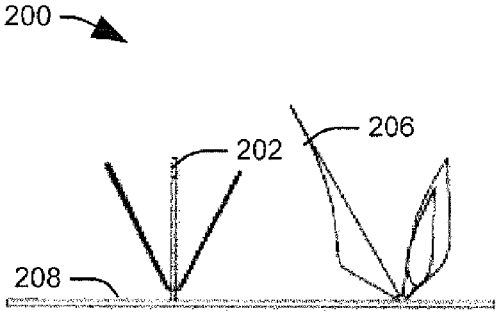
FIG. 17 illustrates a second perspective view of the antenna system illustrated in FIG. 14.

FIG. 14 illustrates an overhead view of a fourth example of an antenna system 200 in accordance with an aspect of the present invention. FIG. 15 illustrates a first perspective view of the antenna system 200 illustrated in FIG. 14. FIG. 16 illustrates a side view of the antenna system 200 illustrated in FIG. 14. FIG. 17 illustrates a second perspective view of the antenna system 200 illustrated in FIG. 14. FIGS. 14-17 each share common numbering for the various elements comprising the antenna system 200.

The illustrated antenna system 200 comprises three antenna assemblies 202, 204, and 206 connected to associated antenna feed connectors through an associated circular ground plane 208. First and second antenna assemblies 202 and 204 each include a plurality of linear elements of differing lengths joined at a common apex at respective first ends in a configuration similar to the antenna assemblies 52 and 54 of FIGS. 2-5. A third antenna assembly 206 includes a plurality of radiative elements formed as oblique, elliptical cones, with each of the cones having an open base and being connected to the connection point and to one another at their respective apexes in a configuration similar to the second antenna assembly 104 of FIGS. 6-9. In the illustrated implementation, the connection points of each antenna assembly 202, 204, and 206 is positioned as to be spaced evenly around a circle having its center at the centroid of the ground plane. In this configuration, the antenna assemblies 202, 204, and 206 can be separated by a distance significantly less than a quarter of the characteristic wavelength of the antenna system 200 while still maintaining a correlation coefficient greater than 0.5.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

I claim:

1. A multiple input, multiple output (MIMO) antenna system comprising:

an electrically conductive, substantially planar, ground reference configured such that a maximum distance between any two points on the ground reference is less than one wavelength associated with an operating frequency of the antenna; and a plurality of antenna assemblies electrically connected to respective antenna feeds at respective connection points and extending on a first side of the ground reference, each of the plurality of antenna assemblies being formed from a conductive material and rotationally asymmetric around an axis perpendicular to the ground reference and passing through the connection point, each of the plurality of antenna assemblies comprising multiple conductive elements joined at a common apex and extending at an oblique angle relative to the ground reference.

2. The MIMO antenna system of claim 1, wherein the multiple conductive elements for a given one of the plurality of antenna assemblies comprises a plurality of oblique, elliptical cones, each having an open base and connected to the connection point and to one another at their respective apexes.

3. The MIMO antenna system of claim 1, wherein the multiple conductive elements for a given one of the plurality of antenna assemblies comprises a plurality of linear segments connected to the connection point and to one another at respective first ends.

4. The MIMO antenna system of claim 3, wherein none of the plurality of linear segments is the same length.

5. The MIMO antenna system of claim 3, wherein the oblique angle is substantially equal to sixty degrees for each of multiple conductive elements.

6. The MIMO antenna system of claim 1, wherein the plurality of antenna assemblies share a common three-dimensional shape.

7. The MIMO antenna system of claim 5, wherein the plurality of antenna assemblies are oriented such that a same location on the common three-dimensional shape faces a centroid of the ground reference for each antenna assembly.

8. The MIMO antenna system of claim 1, wherein the ground reference is circular.

9. The MIMO antenna system of claim 8, wherein an associated footprint of each of the plurality of antenna assemblies has a diameter not less than one-quarter of a diameter of the ground plane.

10. The MIMO antenna assembly of claim 1, wherein the connection points of each antenna assembly is positioned as to be spaced evenly around a circle having its center at the centroid of the ground reference.

11. A multiple input, multiple output (MIMO) antenna system comprising:

an electrically conductive, substantially planar, ground reference; and a plurality of antenna assemblies electrically connected to respective antenna feeds at respective connection points and extending on a first side of the ground reference, each of the plurality of antenna assemblies being formed from multiple conductive elements joined at a common apex as to be evenly spaced around the apex and extending at an oblique angle relative to the ground reference, each of the plurality of antenna assemblies being rotationally asymmetric around an axis perpendicular to the ground reference and passing through the connection point.

12. The MIMO antenna system of claim 11, wherein a given one of the plurality of antenna assemblies comprises a plurality of oblique, elliptical cones, each having an open base and connected to the connection point and to one another at their respective apexes.

13. The MIMO antenna system of claim 12, wherein a given one of the plurality of antenna assemblies comprises a plurality of linear segments, none of which share a common length, connected to the connection point and to one another at respective first ends.

14. The MIMO antenna system of claim 11, wherein a maximum distance between any two points on the ground reference is less than nine times a length of a longest of the multiple conductive elements.

15. A MIMO antenna system comprising:

a substantially circular planar ground reference; and three antenna assemblies extending on a first side of the ground reference and electrically connected to respective antenna feeds at respective connection points evenly spaced around a circle having its center at the centroid of the ground reference, each of the plurality of antenna assemblies being formed from a conductive material and comprising multiple conductive elements joined at a common apex and extending at an oblique angle relative to the ground reference and each of the plurality of antenna assemblies being rotationally asymmetric around an axis perpendicular to the ground reference and passing through the connection point; wherein a maximum distance between any two points on the ground reference is less than nine times a length of a longest of the multiple conductive elements.

16. The MIMO antenna system of claim 15, wherein the multiple conductive elements for a first antenna assembly of the three antenna assemblies comprises a plurality of linear segments connected to the connection point and to one another at respective first ends.

17. The MIMO antenna system of claim 16, wherein the multiple conductive elements for a second antenna assembly of the plurality of antenna assemblies comprises a plurality of oblique, elliptical cones, each having an open base and connected to the connection point and to one another at their respective apexes.

18. The MIMO antenna system of claim 15, wherein a maximum distance between any two points on the ground reference is less than four times a length of a longest of the multiple conductive elements.

19. A multiple input, multiple output (MIMO) antenna system comprising:

an electrically conductive, substantially planar, ground reference; and a plurality of antenna assemblies electrically connected to respective antenna feeds at respective connection points, with each antenna having only a single connection point located substantially at a center of a footprint of the antenna assembly, and extending on a first side of the ground reference, each of the plurality of antenna assemblies being formed from a conductive material, comprising multiple conductive elements joined at a common apex and extending at an oblique angle relative to the ground reference, and rotationally asymmetric around an axis perpendicular to the ground reference and passing through the connection point;

wherein a maximum distance between any two points on the ground reference is less than nine times a length of a longest of the multiple conductive elements.

20. The MIMO antenna system of claim 19 wherein a maximum distance between any two points on the ground reference is less than four times a length of a longest of the multiple conductive elements.

* * * * *